US007246625B2

(12) United States Patent
Ekelhoff

(10) Patent No.: US 7,246,625 B2
(45) Date of Patent: Jul. 24, 2007

(54) DISHWASHER

(75) Inventor: Erik Ekelhoff, Bielefeld (DE)

(73) Assignee: Miele & Cie. GmbH & Co., Guetersloh (DE)

( * ) Notice: Subject to any disclaimer, the term of this patent is extended or adjusted under 35 U.S.C. 154(b) by 832 days.

(21) Appl. No.: 10/001,838

(22) Filed: Nov. 27, 2001

(65) Prior Publication Data

US 2002/0062849 A1 May 30, 2002

(30) Foreign Application Priority Data

Nov. 28, 2000 (DE) ..... 100 59 112

(51) Int. Cl.
*B08B 3/00* (2006.01)
*D06F 33/00* (2006.01)

(52) U.S. Cl. ..... 134/56 D; 134/57 D; 134/113; 68/12.02

(58) Field of Classification Search ..... 134/113, 134/56 D, 57 D; 68/12.02
See application file for complete search history.

(56) References Cited

U.S. PATENT DOCUMENTS 5,140,168 A 8/1992 King
5,331,177 A 7/1994 Kubisiak et al.
5,555,583 A * 9/1996 Berkcan ..... 134/57 D X
5,586,567 A * 12/1996 Smith et al. ..... 134/57 D
5,800,628 A 9/1998 Erickson et al.
5,831,727 A * 11/1998 Stream ..... 356/246

FOREIGN PATENT DOCUMENTS

| | | | | |
|---|---|---|---|---|
| DE | 197 05 927 | | 8/1998 | |
| DE | 198 31 688 | | 4/2000 | |
| EP | 1092384 | A2 * | 4/2001 | |
| EP | 1180344 | * | 2/2002 | |
| EP | 1180344 | A2 * | 2/2002 | |
| JP | 215736 | * | 8/1992 | ..... 134/57 D |
| JP | 215736 | A * | 8/1992 | |
| JP | 319239 | * | 11/1992 | ..... 134/57 D |
| JP | 319329 | A * | 11/1992 | |
| JP | 269075 | * | 10/1993 | ..... 134/57 D |
| JP | 269075 | A * | 10/1993 | |

* cited by examiner

*Primary Examiner*—Michael Barr
*Assistant Examiner*—Jason P. Riggleman
(74) *Attorney, Agent, or Firm*—Darby & Darby

(57) ABSTRACT

The invention related a dishwasher provided in a substantially horizontal section of a wash fluid conduit with a section of continuously increasing flow cross section to form a measuring zone of quieted wash fluid flow to separate foam and air bubbles from the fluid whose suspended contaminant particles are to be measured by a turbidimeter.

8 Claims, 2 Drawing Sheets

Figure 1:
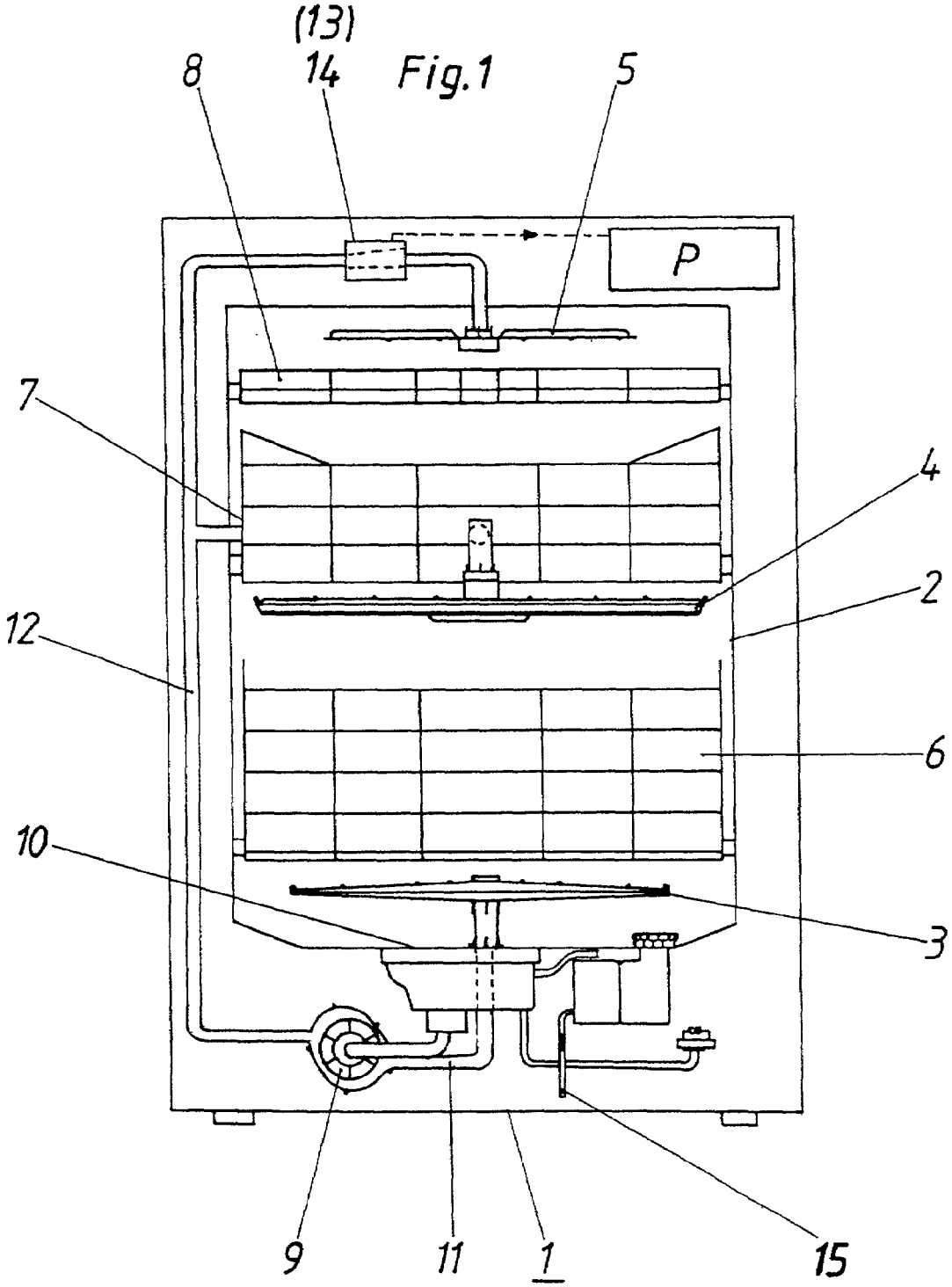

(13)
14

8
5
P
7
4
2
12
6
10
3
9
11
1
15

DISHWASHER

BACKGROUND OF THE INVENTION

1. Field of the Invention

The invention, in general relates to a dishwasher and, more particularly, to a dishwasher provided with a device for substantially preventing the formation of foam and air bubbles in a dampened flow measuring zone of a turbidity sensor disposed in the water circulation path.

2. The Prior Art

In program controlled dishwashers which utilize turbidity sensors for optimizing the washing cycle the problem may arise that dirt particles suspended in the wash fluid as well as foam and air bubbles caused by food residue may move through the measuring path of the sensor and, as a function of the contaminants and admixed air, generate noisy analog measurement signals of uncontrollable voltage levels at the output of a photo receiver. While the noisy signals characterize the degree of contamination of the wash fluid at any given time, they are distorted by the accompanying portion of bubbles and/or foam. As a result, digital signal processing corresponding to the actual degree of wash fluid contamination for controlling the washing operation is complicated. To prevent this problem, it has been proposed to move the wash fluid within the measuring zone at a dampened flow.

OBJECTS OF THE INVENTION

It is an object of the invention to provide an improved dishwasher in which the formation of foam and air bubbles in the wash fluid within the area of the measuring zone of a turbidity sensor is substantially prevented.

Other objects will in part be obvious and will in part appear hereinafter.

SUMMARY OF THE INVENTION

In the accomplishment of these and other objects the invention provides, in a currently preferred embodiment of a dishwasher, for the prevention or at least substantial suppression of foam and air bubble formation in the wash fluid, a turbidity sensor mounted in a substantially horizontally disposed passage of the wash fluid and being of enlarged flow diameter relative to its forward input conduit.

The invention advantageously separates foam and/or air bubbles in the area of the measuring zone from the wash fluid to be monitored. In this manner, signal evaluation is significantly facilitated, with "swimming particles" in the measuring path of the optical sensor, which absorb the light from an optical system, actually recognized only as signal steps being filtered and converted into usable signals. The computer of the electronic program control of the dishwasher may subsequently evaluate the digitized signal steps for controlling the program cycle of the dishwasher in respect of kind and quantity of the contamination, without being affected by foam and air bubbles carried in the wash fluid.

DESCRIPTION OF THE SEVERAL DRAWINGS

Figure 2:
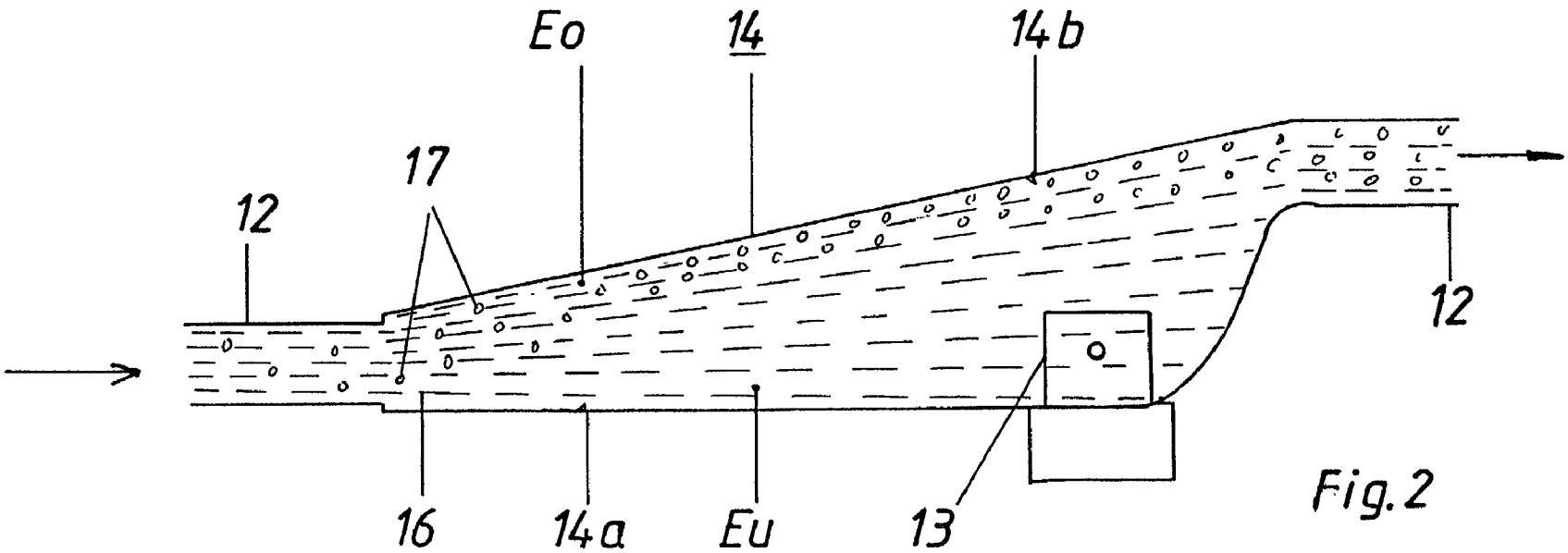

The novel features which are considered to be characteristic of the invention are set forth with particularity in the appended claims. The invention itself, however, in respect of its structure, construction and lay-out as well as manufacturing techniques, together with other objects and advantages thereof, will be best understood from the following description of preferred embodiments when read in connection with the appended drawings, in which:

FIG. 1 is a cross-sectional view of a program controlled dishwasher its components and accessories being shown in a simplified manner with a turbidity sensor being provided in the water circulation system for detecting the degree of contamination of the wash fluid; and FIG. 2 is a device for preventing foam and air bubbles from collecting in the measuring zone of the turbidity sensor.

DETAILED DESCRIPTION OF THE PREFERRED EMBODIMENT

The invention is based upon an electronically program controlled dishwasher 1, the manually or automatically selectable dish washing program of which includes program sections, such as pre-wash, main wash, intermediate wash and final rinse. Depending upon the detected state of soiling of the dishes loaded into the machine, the pre-wash and intermediate wash may either be eliminated or added to the cycle. The final rinse step is usually followed by a drying step. Dishwashers of this type are well known in the art and essentially include the components and accessories indicated in simplified form in the household dishwasher shown in FIG. 1. The program control P of the machine has been shown schematically only; a detailed rendition is not being shown for the sake of clarity.

The schematically shown front-loading dishwasher 1 is provided with a sudsing chamber 2 and several wash arms 3, 4, 5 arranged in different planes in the chamber 2 above and between dish racks 6, 7 and in a separate basket 8 for flatware. The wash arms 3, 4, 5 are supplied with circulating wash fluid by way of associated feed lines 11, 12 from a circulating pump 9. During a washing operation the wash fluid is continually fed through a filter strainer combination 10 consisting of a fine strainer and a coarse strainer as well as a very fine strainer disposed at the bottom of the sudsing chamber 2. These serve to filter any food residue out of the wash fluid 16. The basket 8 for flatware is formed as a drawer and is arranged in the chamber 2 with its own wash arm 5 in a plane separate from the dish racks 6, 7.

The wash fluid fed from a fresh water connection 15 to the sudsing chamber 2 for the washing of dishes is substantially controlled from the quantity of dishes to be washed. The quantity or changes of water during a washing cycle also depend upon the degree of soiling of the dishes. In particular, wash water contaminations caused by hard to dissolve dirt particles, such as, for instance, spinach residue or the like, "swimming" in the wash fluid, may negatively affect the result of the wash. In order also to recognize such particles and automatically appropriately to adjust the control of the washing cycle, the dishwasher 1 is provided with an optical sensor functioning as a turbidity sensor 13 which is connected to the program control P and detects the turbidity of the wash fluid at predetermined points in time during the previously mentioned program steps such as pre-wash, wash and/or intermediate wash, for instance after fresh water has been fed into the sudsing chamber 2, and which delivers a measurement signal corresponding to the degree of contamination. To this end, the turbidity sensor 13 which consists of a light emitting element or diode (LED) as well as a light receiving element such as, for example, a photo transistor, is disposed within a measuring zone 14 through which the wash fluid 16 (see FIG. 2) is fed at a quieted, i.e., moderate flow to be examined for contamination.

To form the quieted flow path, the turbidity sensor 13 is efficaciously disposed in the feed conduit 12 of the upper wash arm 5. However, the quieted measuring zone 14 may also be installed in the feed conduit of one of the other wash arms 3 or 4 of the dishwasher 1. Alternatively, it may be of advantage to place the measuring zone 14 in a by-pass or a parallel side branch leading to one of the feed conduits 11 or 12 of a wash arm, in which only a small portion of the entire wash fluid 16 flows in a quieted manner.

In order to insure separation of air bubbles 17 which may otherwise be present in the circulating wash fluid 16 and prevent them from being erroneously detected as dirt particles, the measuring zone 14 and the turbidity sensor 13 are disposed in a horizontally extending portion of the wash arm feed conduit 12, and in accordance with the invention it is of enlarged cross-section relative to the input feed conduit, as has been clearly shown in FIG. 2. The cross section is flaring out in the direction of flow of the wash fluid 16 and thus quiets or calms the flow of the fluid. In addition, the measuring zone 14 combines quieted flow with a foam or air bubble separator.

The enlarged flow cross section is formed by a conduit (conduit section 14*b*) for the wash fluid 16 which is steadily increasing relative to the horizontal plane 14*a* of the measuring zone 14. Within this conduit section 14*b* air bubbles 17 collect above or outside of the measuring area of the turbidity sensor 13. This insures fluid movement to take place in plane $E_u$ of the measuring zone and air bubble or foam movement to occur in the upper plane $E_o$ of the device 13, 14. The turbidity sensor 13 may thus optimally detect the actual degree of contamination. The cross sectional extent of the measuring zone 14 is preferably structured in the manner of a trapezoid with the turbidity sensor 13 being disposed in the area of the largest cross section in the lower plane $E_u$ or bottom portion 14*a*. The described measuring zone 14 may be easily manufactured and installed as a separate injection molded plastic part.

The quieted measuring zone 14 may, however, also be arranged in a horizontal wash arm supply conduit 12 in a lower section of the machine, as well as in the water feed conduit 11, 12 ahead of or behind a rotationally controllable circulation pump 9. At low rotations, a rotationally controlled circulation pump 9 advantageously provides an especially quiet flow ahead of the turbidity sensor 13.

The device here described in the context of a program controlled dishwasher may also be used in a program-controlled laundry washing machine.

What is claimed is:

1. A dishwasher, comprising:

means for forming a sudsing chamber;

a wash fluid recirculation circuit including at least one conduit disposed in a substantially horizontal disposition for feeding wash fluid in a predetermined direction;

at least one washing arm mounted in the chamber and connected to the recirculation circuit;

a measuring zone within the conduit and comprising a steadily enlarging flow cross section relative to the conduit; and a turbidity sensor mounted in the measuring zone for providing signals representative of dirt particles in the wash fluid.

2. The dishwasher of claim 1, wherein the enlarged flow cross section comprises a wash fluid conduit section of continuously enlarging cross-section in the flow direction.

3. The dishwasher of claim 2, wherein the enlarged flow cross section constitutes a measuring zone of quieted wash fluid flow wherein wash fluid is transported in a lower plane and gas containing portions of the wash fluid are transported in a plane above the lower plane.

4. The dishwasher of claim 3, wherein the enlarged flow cross section of substantially trapezoidal configuration.

5. The dishwasher of claim 4, wherein the turbidity sensor is mounted in the widest area of the measuring zone in the lower plane.

6. The dishwasher of claim 1, wherein the conduit feed a wash arm in a upper section of the chamber.

7. The dishwasher of claim 1, further comprising a recirculation pump connected to the conduit forwardly of the measuring zone.

8. The dishwasher of claim 1, further comprising a recirculation pump connected to the conduit at an input of the measuring zone.

* * * * *